US009441188B2

(12) United States Patent
Schramm, Jr. et al.

(10) Patent No.: US 9,441,188 B2
(45) Date of Patent: Sep. 13, 2016

(54) FABRIC CONDITIONING COMPOSITION

(71) Applicant: Colgate-Palmolive Company, New York, NY (US)

(72) Inventors: Charles J. Schramm, Jr., Hillsborough, NJ (US); Katie Truong, Piscataway, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 14/649,981

(22) PCT Filed: Dec. 11, 2012

(86) PCT No.: PCT/US2012/068961

§ 371 (c)(1),
(2) Date: Jun. 5, 2015

(87) PCT Pub. No.: WO2014/092690

PCT Pub. Date: Jun. 19, 2014

(65) Prior Publication Data

US 2015/0337238 A1 Nov. 26, 2015

(51) Int. Cl.

| | |
|---|---|
| ***C11D 1/52*** | (2006.01) |
| ***C11D 3/20*** | (2006.01) |
| ***C11D 3/384*** | (2006.01) |
| ***C11D 3/00*** | (2006.01) |
| ***C11D 17/00*** | (2006.01) |
| ***C11D 3/37*** | (2006.01) |

(52) U.S. Cl.

CPC ..... *C11D 3/001* (2013.01); *C11D 1/521* (2013.01); *C11D 3/0015* (2013.01); *C11D 3/2093* (2013.01); *C11D 3/3773* (2013.01); *C11D 17/0017* (2013.01)

(58) Field of Classification Search

CPC ..... C11D 1/52; C11D 3/20; C11D 3/2093; C11D 3/3769; C11D 3/3773; C11D 3/384; C11D 17/0017

See application file for complete search history.

(56) References Cited

U.S. PATENT DOCUMENTS

| | | | | |
|---|---|---|---|---|
| 3,920,563 | A | 11/1975 | Wixon | |
| 4,127,694 | A | 11/1978 | Murphy et al. | |
| 4,308,151 | A | 12/1981 | Cambre | |
| 5,919,750 | A | 7/1999 | Iacobucci | |
| 6,844,311 | B2 | 1/2005 | Ellson et al. | |
| 6,894,011 | B2 | 5/2005 | Ellson et al. | |
| 2002/0146438 | A1* | 10/2002 | Bleckmann ..... | B01F 17/0028 424/401 |
| 2007/0054835 | A1 | 3/2007 | Corona, III et al. | |
| 2010/0041583 | A1 | 2/2010 | Ponder et al. | |

FOREIGN PATENT DOCUMENTS

| | | |
|---|---|---|
| EP | 2053119 | 4/2009 |
| GB | 1493202 | 11/1977 |
| GB | 1499441 | 2/1978 |
| WO | WO 97/17419 | 5/1997 |
| WO | WO 2006/007911 | 1/2006 |
| WO | WO 2011/120836 | 10/2011 |
| WO | WO 2011/123606 | 10/2011 |
| WO | WO 2012/075086 | 6/2012 |

OTHER PUBLICATIONS

International Search Report and Written Opinion in International Application No. PCT/US2012/068961, mailed Sep. 18, 2013.

* cited by examiner

*Primary Examiner* — Brian P Mruk

(57) ABSTRACT

A fabric conditioning composition comprising an emulsion of particles in an aqueous vehicle, the particles comprising (a) fatty acid triglyceride, and (b) a water swellable cationic polymer.

33 Claims, No Drawings

FABRIC CONDITIONING COMPOSITION

BACKGROUND OF THE INVENTION

The costs of raw materials required for production of triethanol amine based esterquats such as fatty acids and dimethyl sulfate are increasing significantly in line with oil price increases. TEA esterquats are composed of mono-, di-, and tri-esterquats and mono-, di-, and tri-ester amines. This complicated chemistry results in emulsions that contain several types of emulsion structures, some of which do not effectively contribute to softening performance upon dilution in water during the rinse cycle of a fabric washing process because of their high solubility in water. This becomes particularly noticeable in fabric softening compositions in which the initial product active levels are reduced, resulting in less structure in the initial product emulsion.

Another difficulty of this esterquat system is that the complicated chemistry also makes it hard for a formulator to adjust or add other ingredients to the formulation: each emulsion structure reacts in its own way to the formula change and makes it very difficult for the formulator to balance all the different changes.

There is therefore a need in the art for a fabric conditioning composition, in particular for use as a fabric softening composition, which can have at least one of lower cost, a less complex formulation and/or manufacturing process, equivalent or higher softening and/or fragrance delivery performance, and consistent and predictable properties and performance as compared to known esterquat compositions.

There is, in particular, a need in the art for a fabric conditioning composition for use in a fabric conditioner which can have a lower cost but at least a substantially equivalent softening and fragrance delivery performance as compared to known esterquat compositions for fabric conditioners.

BRIEF SUMMARY OF THE INVENTION

The present invention accordingly provides a fabric conditioning composition comprising an emulsion of particles in an aqueous vehicle, the particles comprising (a) fatty acid triglyceride, and (b) a water swellable cationic polymer.

In certain embodiments, the water swellable cationic polymer is at least one of (i) a cationic linear copolymer that is derived from the polymerization of acrylic acid and/or methacrylic acid, or a salt of acrylic acid and/or methacrylic acid, and acrylamide or methacrylamide, said copolymer having a molecular weight of from about 10,000 to about 30 million; and (ii) a cationic cross-linked polymer that is derived from the polymerization of from 5 to 100 mole percent of cationic vinyl addition monomer, from 0 to 95 mole percent of acrylamide, and from 70 ppm to 300 ppm of a difunctional vinyl addition monomer cross linking agent; or a mixture of polymers (i) and (i).

Optionally, the fatty acid triglyceride has a degree of saturation of from 10 to 85%. Optionally, the fatty acid triglyceride has an iodine value of from 20 to 140.

Optionally, the cationic linear copolymer (i) is derived from the polymerization of a salt of methacrylic acid and acrylamide.

Optionally, in the polymerization of the cationic linear copolymer (i) the salt comprises a quaternary ammonium salt of an acrylate or methacrylate, further optionally a quaternary ammonium salt of dimethyl aminoethyl methacrylate.

Optionally, the cationic linear copolymer (i) has a molecular weight of from about 2 million to about 3 million.

Optionally, the cationic cross-linked polymer (ii) is derived from the polymerization using 75 to 200 ppm of the cross-linking agent, further optionally using 80 to 150 ppm of the cross-linking agent.

Optionally, the cationic cross-linked polymer (ii) is derived from the polymerization of a salt of methacrylic acid and acrylamide.

Optionally, in the polymerization of the cationic cross-linked polymer (ii) the salt comprises a quaternary ammonium salt of an acrylate or methacrylate, further optionally a quaternary ammonium salt of dimethyl aminoethyl methacrylate.

Optionally, in the polymerization of the cationic cross-linked polymer (ii), the polymer prior to cross-linking has a molecular weight of from about 2 million to about 3 million.

Optionally, in the polymerization of the cationic cross-linked polymer (ii), the cross-linker comprises methylene bis-acrylamide.

Optionally, the composition comprises from 2.5 to 7.5 wt % fatty acid triglyceride, further optionally from 4 to 5 wt % fatty acid triglyceride, yet further optionally about 4.5 wt % fatty acid triglyceride, based on the weight of the composition.

Optionally, the composition comprises from 0.05 to 0.5 wt % of the water swellable cationic polymer, further optionally from 0.1 to 0.5 wt % of the water swellable cationic polymer, yet further optionally from 0.15 to 0.25 wt % or 0.15 to 0.2 wt % of the water swellable cationic polymer, based on the weight of the composition.

Optionally, the weight ratio of fatty acid triglyceride to the water swellable cationic polymer is from 30:1 to 20:1.

Optionally, the composition further comprises a fragrance in an amount of from 0.25 to 1 wt % fragrance, further optionally from 0.4 to 0.6 wt % fragrance, based on the weight of the composition.

Optionally, the composition further comprises a plurality of capsules encapsulating the fragrance. Optionally, the capsules are cationic.

Optionally, the capsules are present in an amount of from 0.1 to 0.5 wt %, based on the weight of the composition.

Optionally, the fragrance and capsules are present in weight ratio of from 2:1 to 1:2.

Optionally, the particles have an average particle size of from 3 to 10 microns, further optionally from 4 to 6 microns.

Optionally, the particles have an average particle size of from 0.1 to 2 microns, further optionally from 0.5 to 1 micron.

Optionally, the emulsion particles of the fatty acid triglyceride and the water swellable cationic polymer constitute the sole fabric conditioning component in the composition.

Optionally, the composition comprises no chelating compound.

The present invention further provides a method of producing a fabric conditioning composition according to the invention, the method comprising the steps of:

a) providing water at a temperature of from 30 to 65° C.;
b) dispersing the fatty acid triglyceride and the water swellable cationic polymer, either together or independently in any order, into the water; and
c) mixing the resultant dispersion to produce the composition in which the fatty acid triglyceride is dispersed as an aqueous emulsion, and the aqueous emulsion comprises particles including a mixture of the fatty acid triglyceride and the water swellable cationic polymer.

Optionally, in step a) the water is at a temperature of from 40 to 60° C.

Optionally, in step c) the mixing is carried out so that the particles have an average particle size of from 3 to 10 microns, further optionally from 4 to 6 microns.

Optionally, in step c) the mixing is carried out for a period of from 1 to 4 minutes using a shearing mixer to form the emulsion.

Optionally, in step b) an oil phase comprising a mixture of the fatty acid triglyceride and the water swellable cationic polymer is dispersed into the water in the form of a molten liquid.

Optionally, the molten liquid includes fragrance.

Optionally, the method further comprises the step of:

d) homogenizing the aqueous emulsion formed in step c) by passing the emulsion through a homogenizer at a pressure of from $2.1\times10^7$ to $1.03\times10^8$ Pa (3,000 to 15,000 psi) to form a homogenized emulsion.

Optionally, the homogenizing step d) is carried out at a pressure of from $3.4\times10^7$ to $8.9\times10^7$ Pa (5,000 to 13,000 psi), further optionally from $6.9\times10^7$ to $8.3\times10^7$ Pa (10,000 to 12,000 psi).

Optionally, the homogenized emulsion comprises particles having an average particle size of from 0.1 to 2 microns, further optionally from 0.5 to 1 micron.

Optionally, in the homogenizing step d) the emulsion is at a temperature of from 30 to 75° C., further optionally from 40 to 60° C.

The present invention also provides a method of softening a fabric comprising treating the fabric with a fabric conditioning composition of the invention or produced by a method of the invention.

Optionally, the composition further comprises a fragrance and the method provides fragrance delivery onto the fabric.

The present invention further provides the use of a composition according to the invention or produced by a method of the invention as a fabric softener.

The present invention is at least partly predicated on the finding by the present inventors that a water swellable cationic polymer that is comprised of monomers that are less than 100% quaternized, such as, the cationic linear copolymer (i) identified above and/or the cationic cross-linked polymer (ii) identified above, when used alone or as a mixture, can act as an effective polymeric dispersion/deposition aid for fatty acid triglyceride to provide a stable dispersion of the fatty acid triglyceride in water, in particular to provide an aqueous emulsion of particles of the fatty acid triglyceride and the cationic linear/cross-linked polymer which is effective in softening performance and fragrance delivery.

In particular, the inventors found that low cost fatty acid triglycerides from both animal and plant sources could be provided which exhibited a less complicated chemical composition than known mixtures of mono-. di- and tri-esterquats and reduces the potential loss of active softening actives during the fabric rinse process.

However, by combining the fatty acid triglyceride with the water swellable cationic polymer in accordance with the preferred embodiments of the invention, the stability and performance of the fatty acid triglyceride can be enhanced, to provide a fabric conditioning composition exhibiting substantially similar performance in fabric softening and fragrance delivery intensity as known esterquat compositions.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION OF THE INVENTION

The following description of the preferred embodiment(s) is merely exemplary in nature and is in no way intended to limit the invention, its application, or uses.

AI refers to the active weight of the combined amounts for monoesterquat, diesterquat, and triesterquat.

Delivered AI refers to the mass (in grams) of esterquat used in a laundry load. A load is 3.5 kilograms of fabric in weight. As the size of a load changes, for example using a smaller or larger size load in a washing machine, the delivered AI adjusts proportionally.

The present invention provides a fabric conditioning composition comprising an emulsion of particles in an aqueous vehicle, the particles comprising (a) fatty acid triglyceride, and (b) a water swellable cationic polymer.

The fatty acid triglyceride can be any animal or plant derived triglyceride. Examples include, but are not limited to, tallow, corn oil, sunflower oil, soybean oil, palm oil, or palm kernel oil. In certain embodiments, the fatty acid triglyceride is tallow triglyceride.

In certain embodiments, the water swellable cationic polymer has a charge density of 4 to 5 meq/g. In other embodiments, the charge density is 4 to 4.5, 4 to less than 4.5, about 4.5, 4.5 to 5, or greater than 4.5 to 5 meq/g.

In one embodiment, the water swellable cationic polymer is at least one of (i) a cationic linear copolymer that is derived from the polymerization of acrylic acid and/or methacrylic acid, or a salt of acrylic acid and/or methacrylic acid, and acrylamide or methacrylamide, said copolymer having a molecular weight of from about 10,000 to about 30 million; and (ii) a cationic cross-linked polymer that is derived from the polymerization of from 5 to 100 mole percent of cationic vinyl addition monomer, from 0 to 95 mole percent of acrylamide, and from 70ppm to 300ppm of a difunctional vinyl addition monomer cross linking agent; or a mixture of polymers (i) and (i).

Optionally, the fatty acid triglyceride has a degree of saturation of from 20 to 85%. Optionally, the fatty acid triglyceride has an iodine value of from 20 to 140.

In certain embodiments, the fatty acid residue of the fatty acid triglyceride may be saturated, to provide a "hard" fatty acid triglyceride, or partly unsaturated, to provide a "soft" fatty acid triglyceride. Typically, the fatty acid triglyceride has a degree of saturation of from 20 to 85%. Optionally, the fatty acid triglyceride has an iodine value of from 20 to 140.

By hard, it is meant that the fatty acid is close to full hydrogenation. In certain embodiments, a fully hydrogenated fatty acid has an iodine value of 10 or less. By soft, it is meant that the fatty acid is no more than partially hydrogenated. In certain embodiments, a no more than partially hydrogenated fatty acid has an iodine value of at least 40. In certain embodiments, a partially hydrogenated fatty acid has an iodine value of 40 to 55. The iodine value can be measured by ASTM D5554-95 (2006). In certain embodiments, a ratio of hard fatty acid to soft fatty acid is 70:30 to 40:60. In other embodiments, the ratio is 60:40 to 40:60 or 55:45 to 45:55. In one embodiment, the ratio is about 50:50. Because in these specific embodiments, each of the hard fatty acid and soft fatty acid cover ranges for different levels of saturation (hydrogenation), the actual percentage of fatty acids that are fully saturated can vary. In certain embodiments, soft tallow contains approximately 47% saturated chains by weight.

The percentage of saturated fatty acids can be achieved by using a mixture of fatty acids to make the esterquat, or the percentage can be achieved by blending fatty acid triglycerides with different amounts of saturated fatty acids.

At higher AI levels, larger amounts of saturated fatty acids deliver more noticeable results than lower AI levels because the absolute amount of saturated fatty acid is greater, which provides a noticeable difference. While there is still a difference in result at lower AI, the result is less noticeable.

In certain embodiments, the fatty acid triglyceride is present in an amount of 0.01 to 35% by weight of the composition, optionally, 1 to 10%, 1 to 8%, 1 to 5%, 1.5 to 5%, or 2 to 4% by weight, preferably 1.5 to 5% or 2 to 4% by weight.

In certain embodiments, the delivered AI is 2.8 to 8 grams per load. In other embodiments, the delivered AI is 2.8 to 7, 2.8 to 6, 2.8 to 5, 3 to 8, 3 to 7, 3 to 6, 3 to 5, 4 to 8, 4 to 7, 4 to 6, or 4 to 5 grams per load.

Fatty acid triglyceride is not highly soluble in water. The water swellable cationic polymer is provided to increase the dispersibility of the fatty acid triglyceride in the water so that the fatty acid triglyceride forms particles of an aqueous emulsion which has stability prior to use and can be delivered to fabric during use to effect fabric softening. The water swellable cationic polymer also aids in deposition of the fatty acid triglyceride onto fabric because the triglyceride has no charge to promote deposition onto fabric.

In embodiments, the cationic surface charge of the emulsion particle, provided by the water swellable cationic polymer (i) and/or (ii), assures that the emulsion particle may exhibit effective fabric deposition during the rinse process.

The water swellable cationic polymers (i) and (ii) employed in the preferred embodiments have good solubility in water and good biodegradability.

In certain embodiments, the cationic linear copolymer (i) is derived from the polymerization of a salt of methacrylic acid and acrylamide. In certain embodiments, in the polymerization of the cationic linear copolymer (i) the salt comprises a quaternary ammonium salt of an acrylate or methacrylate, typically a quaternary ammonium salt of dimethyl aminoethyl methacrylate. In certain embodiments, the cationic linear copolymer (i) has a molecular weight of from about 2 million to about 3 million.

In certain embodiments, the cationic cross-linked polymer (ii) is derived from the polymerization using 75 to 200 ppm of the cross-linking agent, further optionally 80 to 150 ppm of the cross-linking agent. In certain embodiments, the cationic cross-linked polymer (ii) is derived from the polymerization of a salt of methacrylic acid and acrylamide. In certain embodiments, in the polymerization of the cationic cross-linked polymer (ii) the salt comprises a quaternary ammonium salt of an acrylate or methacrylate, typically a quaternary ammonium salt of dimethyl aminoethyl methacrylate. In certain embodiments, in the polymerization of the cationic cross-linked polymer (ii), the polymer prior to cross-linking has a molecular weight of from about 2 million to about 3 million. In certain embodiments, in the polymerization of the cationic cross-linked polymer (ii), the cross-linker comprises methylene bis acrylamide.

In certain embodiments, the composition comprises from 2.5 to 7.5 wt % fatty acid triglyceride, for example from 4 to 5 wt % fatty acid triglyceride, typically about 4.5 wt % fatty acid triglyceride, based on the weight of the composition.

In certain embodiments, the composition comprises from 0.05 to 0.5 wt % of the water swellable cationic polymer, for example from 0.1 to 0.5 wt %, of the water swellable cationic polymer, typically from 0.15 to 0.25 wt % or 0.15 to 0.2 wt % of the water swellable cationic polymer, based on the weight of the composition.

In certain embodiments, the weight ratio of fatty acid triglyceride to the water swellable cationic polymer is from 30:1 to 20:1.

The composition can be provided as a fragrance free composition, or it can contain a fragrance. The amount of fragrance can be any desired amount depending on the preference of the user. In certain embodiments, the composition further comprises from 0.25 to 1 wt % fragrance, typically from 0.4 to 0.6 wt % fragrance, based on the weight of the composition.

The composition may further comprise a plurality of capsules encapsulating some of the fragrance. Optionally, the capsules are cationic, which has been found to enhance the phase stability of the composition. In certain embodiments, the capsules are present in an amount of from 0.1 to 0.5 wt %, based on the weight of the composition. In certain embodiments, the fragrance and capsules are present in weight ratio of from 2:1 to 1:2. Typically, capsule loading is around 45 weight % fragrance oil.

Fragrance, or perfume, refers to odoriferous materials that are able to provide a desirable fragrance to fabrics, and encompasses conventional materials commonly used in detergent compositions to provide a pleasing fragrance and/or to counteract a malodor. The fragrances are generally in the liquid state at ambient temperature, although solid fragrances can also be used. Fragrance materials include, but are not limited to, such materials as aldehydes, ketones, esters and the like that are conventionally employed to impart a pleasing fragrance to laundry compositions. Naturally occurring plant and animal oils are also commonly used as components of fragrances.

In certain embodiments, the fatty acid triglyceride is dispersed as an aqueous emulsion and the emulsion comprises particles including a mixture of the fatty acid triglyceride and the water swellable cationic polymer.

In some embodiments, the particles have an average particle size of from 3 to 10 microns, typically from 4 to 6 microns.

In some embodiments, typically if the emulsion has been homogenized as discussed further below, the particles have an average particle size of from 0.1 to 2 microns, typically from 0.5 to 1 micron.

The fabric conditioners may additionally contain a thickener.

In some embodiments the fabric conditioner may further include a chelating compound. Suitable chelating compounds are capable of chelating metal ions and are present at a level of at least 0.001%, by weight, of the fabric softening composition, preferably from 0.001% to 0.5%, and more preferably 0.005% to 0.25%, by weight. The chelating compounds which are acidic in nature may be present either in the acidic form or as a complex/salt with a suitable counter cation such as an alkali or alkaline earth metal ion, ammonium or substituted ammonium ion or any mixtures thereof. The chelating compounds are selected from among amino carboxylic acid compounds and organo aminophosphonic acid compounds, and mixtures of same. Suitable amino carboxylic acid compounds include: ethylenediamine tetraacetic acid (EDTA); N-hydroxyethylenediamine triacetic acid; nitrilotriacetic acid (NTA); and diethylenetriamine pentaacetic acid (DEPTA). Suitable organo aminophosphonic acid compounds include: ethylenediamine tetrakis (methylenephosphonic acid); 1-hydroxyethane 1,1-diphosphonic acid (HEDP); and aminotri (methylenephosphonic acid). In certain embodiments, the composition can include amino tri methylene phosphonic acid, which is available as Dequest™ 2000 from Monsanto.

In some other embodiments the fabric conditioner comprises no chelating compound, which has been found to reduce the size of the emulsion particle, which may lead to enhanced phase stability.

In certain embodiments, the composition can include a C13-C15 Fatty Alcohol EO 20:1, which is a nonionic surfactant with an average of 20 ethoxylate groups. In certain embodiments, the amount is 0.05 to 0.5 weight %.

In certain embodiments, the composition can contain a silicone as a defoamer, such as Dow Corning™ 1430 defoamer. In certain embodiments, the amount is 0.05 to 0.8 weight %.

The composition can be used to soften fabrics by treating the fabric with the composition. This can be done during the rinse cycle of a wash using a liquid fabric softener.

The present invention also provides a method of producing a composition according to the invention, the method comprising the steps of:

a) providing water at a temperature of from 30 to 65° C.;
b) dispersing the fatty acid triglyceride and the water swellable cationic polymer, either together or independently in any order, into the water; and
c) mixing the resultant dispersion to produce the composition in which the fatty acid triglyceride is dispersed as an aqueous emulsion, and the aqueous emulsion comprises particles including a mixture of the fatty acid triglyceride and the water swellable cationic polymer.

In certain embodiments, in step a) the water is at a temperature of from 40 to 60° C.

In certain embodiments, in step b) an oil phase comprising a mixture of the fatty acid triglyceride and the water swellable cationic polymer is dispersed into the water in the form of a molten liquid.

In certain embodiments, the molten liquid includes fragrance. In certain embodiments, in step c) the mixing is carried out so that the particles have an average particle size of from 3 to 10 microns, optionally from 4 to 6 microns.

In certain embodiments, in step c) the mixing is carried out for a period of from 1 to 4 minutes using a shearing mixer to form the emulsion.

In certain embodiments, the method further comprises the step of:

d) homogenizing the aqueous emulsion formed in step c) by passing the emulsion through a homogenizer at a pressure of from $2.1\times10^7$ to $1.03\times10^8$ Pa (3,000 to 15,000 psi) to form a homogenized emulsion.

In certain embodiments, the homogenizing step d) is carried out at a pressure of from $3.4\times10^7$ to $8.9\times10^7$ Pa (5,000 to 13,000 psi), further optionally from $6.9\times10^7$ to $8.3\times10^7$ Pa (10,000 to 12,000 psi).

In certain embodiments, the homogenized emulsion comprises particles having an average particle size of from 0.1 to 2 microns, further optionally from 0.5 to 1 micron.

In certain embodiments, in the homogenizing step d) the emulsion is at a temperature of from 30 to 75° C., further optionally from 40 to 60° C.

In certain embodiments, no chelating agent is mixed with the triglyceride prior to addition to water.

The present invention also provides a method of softening a fabric comprising treating the fabric with a composition of the invention or produced by a method of the invention.

In certain embodiments, the composition further comprises a fragrance and the method provides fragrance delivery onto the fabric.

The present invention also provides the use of a composition of the invention or produced by a method of the invention as a fabric softener.

The composition can contain any material that can be added to fabric softeners. Examples of materials include, but are not limited to, surfactants, thickening polymers, colorants, clays, buffers, silicones, fatty alcohols, and fatty esters.

SPECIFIC EMBODIMENTS OF THE INVENTION

The invention is further described in the following examples. The examples are merely illustrative and do not in any way limit the scope of the invention as described and claimed.

Examples 1 and 2

In Examples 1 and 2 a fabric conditioner composition based on fatty acid triglyceride was prepared.

In Examples 1 and 2, deionized water was provided at a temperature of 43° C. A water swellable cationic polymer was provided in each Example. In Example 1 the water swellable cationic polymer was a FS100-type linear polymer from SNF having the trade name Flosoft DP100 available in commerce from SNF Floerger. In Example 2 the water swellable cationic polymer was a FS200-type cross-linked polymer from SNF having the trade name Flosoft DP200 available in commerce from SNF Floerger. A buffer in the form of lactic acid was provided. A chelating compound having the formula aminotri(methylenephosphonic acid) in the form of a commercially available chelating compound known under the trade name Dequest 2000 from Monsanto was also provided. In each Example, the respective water swellable cationic polymer (0.3 wt %), buffer (0.071 wt %), and chelating compound (0.1 wt %) were added to the water (94.5 wt %), all percentages being with respect to the final composition, and mixed under high shear for 2 minutes.

Then molten edible soft tallow triglyceride, also at a temperature of 43° C., admixed with fragrance, was added to the aqueous solution of cationic linear polymer, buffer and chelating agent. The tallow triglyceride had an iodine value (IV) of 47.

The tallow triglyceride was added in an amount so as to comprise 4.5 wt % of the final composition. The fragrance was added in an amount so as to comprise 0.5 wt % of the final composition. The resultant mixture was mixed using the high shear mixer for a further period of 4 minutes.

This formed in each of Examples 1 and 2 a stable aqueous emulsion of particles of the mixture of the tallow triglyceride and the water swellable cationic polymer.

The mixing of triglyceride with water alone will not form a stable emulsion. The oil and water will immediately phase separate back to oil and water.

Examples 3 and 4 and Comparative Examples 1 and 2

The product of Example 1 was used as a fabric softening composition which was employed in a fabric softening test in a wash/rinse cycle. In particular, two liters of tap water were added to a 4 liter plastic beaker, then 2.4 grams for Example 3 or 3.6 grams for Example 4 of the composition from Example 1 was added and the mixture was stirred with a spatula. A clean terry hand towel, approximately 110 grams in weight, was added and mixed with the spatula for 4 minutes. The towel was wrung dry and spun in a spinner for 6 minutes to achieve a constant water weight. The towel was line dried. The softness and fragrance delivery intensity were determined by a panel of trained testers for each of Examples 3 and 4.

As Comparative Examples 1 and 2 a fabric conditioning composition comprising 5.5 wt % active ingredient (AI) content of a commercial TEA esterquat was employed in the same test, for Comparative Example 1 using 2.4 grams of the fabric conditioning composition and for Comparative Example 2 using 1.2 grams of the fabric conditioning composition.

The towels of Comparative Example 2 and Examples 3 and 4 were compared to a control of Comparative Example 1 and rated on the scale of −3 (less than the control) to +3 (better than the control).

The results are shown in Table 1.

TABLE 1

| | Comp. Ex. 2 | Ex. 3 | Ex. 4 |
|---|---|---|---|
| Softness | | | |
| Panelist 1 | −1 | −1 | −2 |
| Panelist 2 | −1 | −1 | −2 |
| Panelist 3 | −1 | −1 | −0.5 |
| Panelist 4 | −1 | 0 | +1 |
| Average | −1 | −0.75 | −0.9 |
| Fragrance | | | |
| Panelist 1 | −2 | 0 | −1 |
| Panelist 2 | 0 | 0 | +1 |
| Panelist 3 | −2 | +0.5 | +1 |
| Panelist 4 | −2 | +0.5 | +2 |
| Average | −1.5 | +0.25 | +1 |

The tallow triglyceride fabric conditioning composition demonstrated softening efficacy and very significant potential for fragrance delivery.

Examples 5 to 7 and Comparative Examples 3 and 4

In Example 5 the same fabric conditioning composition of Example 3 was employed in a similar test as in the previous Examples. The composition comprised 2.4 grams of 4.5 wt % AI tallow triglyceride and 0.3 wt % of the FS100 type cationic linear polymer, and the emulsion particle size was 3 microns.

In Example 6 the same fabric conditioning composition of Example 1 was subjected to high pressure homogenization at a pressure of $7.6\times10^7$ Pa (11,000 psi) and at a temperature of 50° C. to reduce the emulsion particle size. The resultant homogenized emulsion was dispersed in water as for Examples 3 and 4 and then employed in a similar test as in the previous Examples. The composition comprised 2.4 grams of 4.5 wt % AI tallow triglyceride and 0.3 wt % of the FS100 type cationic linear polymer, and the emulsion particle size was 0.7 microns.

In Example 7 the fabric conditioning composition of Example 1 was modified by employing an FS200 type cationic cross-linked polymer instead of the FS100 cationic linear polymer. The resultant emulsion was dispersed in water as for Examples 3 and 4 and then employed in a similar test as in the previous Examples. The composition comprised 2.4 grams of 4.5 wt % AI tallow triglyceride and 0.3 wt % of the FS200 type cationic cross-linked polymer, and the emulsion particle size was 7 microns.

In the tests, the softness and fragrance delivery intensity were again determined by a panel of trained testers in the same manner as for each of Examples 3 and 4.

As Comparative Examples 3 and 4, the same respective fabric conditioning compositions of Comparative Examples 1 and 2 were employed and Comparative Example 3 was used as a control. Comparative Examples 3 and 4 respectively used 2.4 and 1.2 grams of the fabric conditioning composition comprising 5.5 wt % AI TEA esterquat.

The towels of Comparative Example 4 and Examples 5, 6 and 7 were compared to a control of Comparative Example 3 and rated on the scale of −3 (less than the control) to +3 (better than the control).

The results are shown in Table 2.

TABLE 2

| | Comp. Ex. 4 | Ex. 5 | Ex. 6 | Ex. 7 |
|---|---|---|---|---|
| Softness | | | | |
| Panelist 1 | −2 | −3 | −0.5 | 0 |
| Panelist 2 | −0.5 | −1 | +1 | +0.5 |
| Panelist 3 | −1 | −1 | +1 | −2 |
| Panelist 4 | −1 | −0.5 | 0 | −1 |
| Panelist 5 | +1 | 0 | +2 | −0.5 |
| Average | −0.7 | −1.1 | +0.7 | −0.1 |
| Fragrance | | | | |
| Panelist 1 | −2 | −3 | −1 | −1 |
| Panelist 2 | +1 | +1 | +1 | +0.5 |
| Panelist 3 | 0 | 0 | +1 | +1 |
| Panelist 4 | −3 | −2 | −1.5 | −2 |
| Panelist 5 | −1 | −1 | +2 | +2 |
| Average | −1 | −0.2 | +0.3 | +0.1 |

The results show that a significant softening and fragrance performance increase was observed for the tallow triglyceride/FS100 cationic linear polymer after high pressure homogenization in Example 6.

The tallow triglyceride/FS200-type cross-linked water swellable cationic polymer in Example 7 provided effective softening and fragrance delivery after high shear mixing.

Examples 8 to 15 and Comparative Example 5

A full load wash test design study was carried out to test the impact of polymer level and high pressure homogenization on the softening and fragrance delivery of the tallow triglyceride/water swellable cationic polymer fabric conditioning compositions.

In Examples 8 to 15, the fabric conditioning compositions were prepared according to Example 6, and were subjected to high pressure homogenization at a pressure of $7.6\times10^7$ Pa (11,000 psi) and at a temperature of 50° C. to reduce the particle size. All high pressure homogenized fabric conditioning compositions in these Examples had an emulsion particle size of 0.7 microns.

The products of these Examples and Comparative Examples were each used as a fabric softening composition which was employed in a fabric softening test using four different amounts in a wash/rinse cycle. The Protocol for the test is described below.

Protocol

Full Load Wash in Standard US Type Washer

Each experiment used 79 grams product added to the rinse after a wash cycle with 90 grams anionic surfactant based detergent. The fabric load consisted of 12 terry had towels (approximately 1.4 Kg) and a mixed clothing load (approximately 1.6 Kg). There was a 15 minute wash cycle and a 4 minute rinse cycle. All terry towels were line dried. A subset of the towels were cut into smaller pieces and evaluated by a trained sensory panel for their fragrance intensity on a scale from 1 to 10. Whole towels were folded and evaluated by a trained sensory panel for their softness intensity on a scale from 1 to 10. Two positive controls, a current commercial TEA esterquat fabric softener product at two different AI levels, as Comparative Examples 5 and 6, were used in the screening tests. All performance data is expressed as relative to the positive control of Comparative Example 5.

There were eight experimental Examples covering high and low polymer use level, polymer type, and homogenized emulsions, using a high pressure homogenizer, or unhomogenized emulsions, using only a high shear mixer. All particle size measurements were carried out using a Malvern 2000 Mastersizer. The volume average particle size is reported.

Table 3 shows the compositions used in Examples 8 to 15 and Comparative Examples 5 and 6. Tallow triglyceride is represented by "TG", the FS100-type linear water swellable cationic polymer is represented by "FS100" and the FS200-type cross-linked water swellable cationic polymer is represented by "FS200". The emulsion particle size is indicated. Homogenized is represented by "H" and high shear/unhomogenized represented by "S". Each composition also included 0.18 wt % anionic fragrance delivery capsules which are conventionally used in esterquat fabric conditioning compositions.

TABLE 3

| Control, Comp. Example 5 | 5 wt % TEA esterquat |
|---|---|
| Example 8 | 4.5 wt % TG, 0.3 wt % FS100, 3 micron, S |
| Example 9 | 4.5 wt % TG, 0.3 wt % FS200, 7 micron, S |
| Example 10 | 4.5 wt % TG, 0.2 wt % FS200, 0.7 micron, H |
| Example 11 | 4.5 wt % TG, 0.2 wt % FS200, 12 micron, S |
| Example 12 | 4.5 wt % TG, 0.2 wt % FS100, 0.7 micron, H |
| Example 13 | 4.5 wt % TG, 0.2 wt % FS100, 7 micron, S |
| Example 14 | 4.5 wt % TG, 0.3 wt % FS200, 0.7 micron, H |
| Example 15 | 4.5 wt % TG, 0.3 wt % FS100, 0.7 micron, H |

TABLE 4

| | Day 1 Fragrance Unrubbed | Day 1 Fragrance Rubbed | Day 7 Fragrance Unrubbed | Day 7 Fragrance Rubbed | Softness |
|---|---|---|---|---|---|
| Example 8 | −1.20 | −1.65 | −0.95 | −1.70 | −0.65 |
| Example 9 | 0.10 | −0.90 | −0.30 | −0.90 | −1.05 |
| Example 10 | 0.05 | 0.12 | 0 | −0.32 | −0.92 |
| Example 11 | 1.05 | 0.50 | 0.50 | 0.15 | −0.85 |
| Example 12 | −0.52 | 0.70 | 0.02 | 0.05 | 0 |
| Example 13 | −1.50 | −0.60 | −0.45 | −0.85 | −1.15 |
| Example 14 | −0.25 | −1.90 | −0.70 | −1.10 | −0.50 |
| Example 15 | −0.20 | −2.00 | −0.60 | −1.95 | 0.30 |

In Table 4 above, Examples 8 to 15 are compared relative to Comparative Example 5 according to the scale of −3 (less than the control) to +3 (better than the control). Within + or −1, the values are parity. A number of the Examples demonstrated tallow triglyceride/water swellable cationic polymer compositions with performance at parity or directionally better than the TEA esterquat control of Comparative Example 5. The highest overall performance was delivered by Example 12 with 0.2 wt % FS100-type linear polymer and homogenized. Both the homogenized and unhomogenized compositions of Examples 10 and 11 with 0.2% FS200-type cross-linked polymer were highly effective for fragrance delivery, and more effective than the FS100-type linear polymer and control compositions.

Fragrance delivery for the FS100-type cationic linear polymer compositions increased with decreasing emulsion particle size in a statistically significant manner whereas in contrast for the FS200-type cationic cross-linked polymer compositions the fragrance delivery showed a directional increase with increasing emulsion particle size.

Although both the FS100-type linear polymers and the FS200-type cross-linked polymers produced fabric conditioner emulsions with effective softening and fragrance delivery, the FS100-type linear polymer system tended to require high pressure homogenization to produce highly effective softening and parity fragrance delivery. The FS200-type cross-linked polymer system with only high shear mixing produced product with directionally better fragrance delivery and only slight lower softening efficacy. Since consumer acceptance tends to be more influenced by good fragrance delivery, both compositions solved the problem of providing effective fragrance delivery as compared to esterquat compositions but at lower cost.

Examples 16 to 23 and Comparative Examples 6 to 9

In Examples 8 to 15 the 4.5 wt % tallow triglyceride compositions delivered at best statistical parity softness with the control TEA esterquat compositions. Therefore in these Examples tallow triglyceride/water swellable cationic polymer composition was tested further to assess the softness performance of a higher amount than 4.5% tallow triglyceride and a lower amount of the water swellable cationic polymer, since the stabilizing water swellable cationic polymer also adds significant cost and thus should ideally be minimized at for the respective tallow amount.

Accordingly, in the following Examples the softness and fragrance delivery were tested for varying tallow triglyceride amounts and water swellable cationic polymer amounts, using a high shear mixing process, and all of the compositions comprised used a free fragrance mixture of 0.5% fragrance and 0.2% encapsulated oil fragrance to determine if overall high fragrance intensities could be achieved with a mixed fragrance system. Fragrance and softness were both evaluated on a 10 (best) to 1 (least) scale.

The results of the tests are shown in Tables 5 and 6 below. All amounts are in wt %.

In Table 6, as well as using a higher tallow triglyceride amount, in Example 20 the fragrance was added in the tallow triglyceride oil phase rather than in the water phase as described above for Examples 1 and 2. Furthermore, in Example 21 no chelating agent, in the form of Dequest 2000, as added in the water phase as described above for Examples 1 and 2.

TABLE 5

| | Active | Polymer | Particle Size (microns) | Day 1 Fragrance | Softness |
|---|---|---|---|---|---|
| Comp. Example 6 | 5% TEA esterquat | 0.1% FS100 | 12 | 4.35 | 7.9 |

TABLE 5-continued

| | Active | Polymer | Particle Size (microns) | Day 1 Fragrance | Softness |
|---|---|---|---|---|---|
| Example 16 | 4.5% tallow triglyceride | 0.2% FS200 | 6 | 4.55 | 6.7 |
| Example 17 | 4.5% tallow triglyceride | 0.3% FS200 | 7 | 3.35 | 6.15 |
| Example 18 | 5.5% tallow triglyceride | 0.3% FS200 | 7 | 3.2 | 4.8 |
| Example 19 | 4.5% tallow triglyceride | 0.2% FS100 | 3 | 3.65 | 4.05 |
| Negative Control - Comp. Example 7 | None | None | — | 2.8 | 2.9 |

TABLE 6

| | Active | Polymer | Particle Size (microns) | Day 1 Fragrance | Softness |
|---|---|---|---|---|---|
| Comp. Example 8 | 5% F1000 | 0.1% FS100 type | 12 | 2.95 | 7.95 |
| Example 20 | 5.5% tallow triglyceride | 0.3% FS200 type in oil phase | 3 | 2.8 | 5.75 |
| Example 21 | 5.5% tallow triglyceride | 0.3% FS200 type no chelating agent | 4 | 3.55 | 4.9 |
| Example 22 | 5.5% tallow triglyceride | 0.3% FS200 type | 7 | 3.15 | 4.55 |
| Example 23 | 5.5% tallow triglyceride | 0.2% FS200 type | 10 | 3.5 | 5.55 |
| Negative Control - Comp. Example 9 | None | None | — | 2.45 | 2.9 |

The results of Table 5 showed that increasing the water swellable cationic polymer: softening active ratio resulted in a reduction of both fragrance and softness delivery. With a higher polymer amount, the increased softening active amount did not deliver better softness or fragrance. Surprisingly, as shown in Example 16, both softness and fragrance were higher with lower water swellable cationic polymer amount and lower softening active amount.

The results of Table 6 showed that the 0.2 wt % polymer level of Example 23 was associated with the best combined fragrance and softness delivery. It was also found that addition of the polymer in the oil phase as provided in Example 20 and removal of the chelating agent as provided in Example 21 Dequest both showed potential for significantly reduced emulsion particle size.

Examples 24 to 31 and Comparative Examples 10 to 13

In these Examples, the softening active amount was 4.5% tallow triglyceride and the water swellable cationic polymer amount was 0.2% FS200-type cross-linked water swellable cationic polymer or 0.2% FS100-type cationic linear polymer. All compositions were mixed using a high shear mixer. The compositions comprising the FS100-type cationic linear polymer were further homogenized at $7.6\times10^7$ Pa (11000 psi). Compositions were prepared with and without the Dequest chelating agent, and by dispersing the water swellable cationic polymer either into the initial water phase or into the combined tallow triglyceride-fragrance oil phase. The resulting compositions were evaluated for softening and fragrance delivery.

The results are shown in Table 7. All of the compositions in Table 7 of Examples 24 to 27 comprised 4.5 wt % tallow triglyceride and 0.2 wt % FS100-type cationic linear polymer.

TABLE 7

| | Active | Particle Size (microns) | Day 1 Fragrance | Day 7 Fragrance | Softness |
|---|---|---|---|---|---|
| Comp. Ex. 10 | 5 wt % TEA esterquat | 12 | 4.55 | 3.8 | 6.5 |
| Example 24 | Cationic polymer added to Water Phase | 1 | 3.8 | 3.95 | 4.15 |
| Example 25 | Cationic polymer added to Water Phase, No Dequest chelating agent | 1 | 4.35 | 4.5 | 4.8 |
| Example 26 | Cationic polymer added to Oil Phase | 1 | 3.85 | 4.05 | 5.65 |
| Example 27 | Cationic polymer added to Oil Phase, No Dequest chelating agent | 1 | 4.4 | 3.4 | 6.6 |
| Negative control - Comp. Ex. 11 | None | — | 2.45 | 2.55 | 4.85 |

The Examples show that improved softening and fragrance delivery performance was achieved by employing the water swellable cationic polymer being added to the oil phase and no Dequest chelating agent, as in Example 27.

Corresponding tests for Examples 28 to 31 were carried out on compositions which comprised 4.5 wt % tallow triglyceride and 0.2 wt % FS200-type cationic cross-linked water swellable cationic polymer. The results are shown in Table 8.

TABLE 8

| | Active | Particle Size (microns) | Day 1 Fragrance | Day 7 Fragrance | Softness |
|---|---|---|---|---|---|
| Comp. Ex. 12 | 5 wt % TEA esterquat | 12 | 5.2 | 3.75 | 7.35 |
| Example 28 | Cationic polymer added to Water Phase | 6 | 4.6 | 3.95 | 5.9 |
| Example 29 | Cationic polymer added to Water Phase, No Dequest chelating agent | 7 | 3.95 | 3.2 | 4.25 |
| Example 30 | Cationic polymer added to Oil Phase | 4 | 4.55 | 3.05 | 5.0 |
| Example 31 | Cationic polymer added to Oil Phase, No Dequest chelating agent | 4 | 5.65 | 4.65 | 6.35 |
| Negative control - Comp. Ex. 13 | None | — | 2.95 | 2.4 | 3.25 |

These Examples show that adding polymer in the oil phase produced a product with consistently lower particle size. Again the best overall performance was delivered by Example 31 when the polymer was mixed with the oil phase and no Dequest chelating agent was added to the water phase. In addition, the composition of Example 31 showed good stability at room temperature after 8 weeks aging.

Example 32

A composition similar to Example 1 is prepared except that the water swellable cationic polymer used is Rheovis FRC cationic polymer from BASF. Example 32 uses 1 weight % tallow triglyceride, 0.4 weight % fragrance, 0.18 weight % fragrance capsules and 0.3 weight % Rehovis FRC cationic polymer. This type of water swellable cationic polymer is also able to form an effective fabric conditioner. The results for fragrance and softness evaluations for this composition are shown Table 9 below.

TABLE 9

| | Day 1 Fragrance Unrubbed | Day 1 Fragrance Rubbed | Day 7 Fragrance Unrubbed | Day 7 Fragrance Rubbed | Softness |
|---|---|---|---|---|---|
| Ex. 32 | 4.06 | 6.11 | 5.19 | 6.81 | 5.65 |

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

We claim:

1. A fabric conditioning composition comprising an emulsion of particles in an aqueous vehicle, the particles comprising (a) fatty acid triglyceride, and (b) a water swellable cationic polymer, wherein the water swellable cationic polymer is at least one of (i) a cationic linear copolymer that is derived from the polymerization of acrylic acid and/or methacrylic acid, or a salt of acrylic acid and/or methacrylic acid, and acrylamide or methacrylamide, said copolymer having a molecular weight of from about 10,000 to about 30 million; and (ii) a cationic cross-linked polymer that is derived from the polymerization of from5 to 100 mole percent of cationic vinyl addition monomer, from 0 to 95 mole percent of acrylamide, and from 70 ppm to 300 ppm of a difunctional vinyl addition monomer cross linking agent or a mixture of polymers (i) and (ii).

2. The composition of claim 1, wherein the fatty acid triglyceride is tallow triglyceride.

3. The composition of claim 1, wherein the fatty acid triglyceride has a degree of saturation of from 10 to 85%.

4. The composition of claim 1, wherein the fatty acid triglyceride has an iodine value of from 20 to 140.

5. The composition of claim 1, wherein the fatty acid triglyceride is present in an amount of 0.01 to 35% by weight of the composition.

6. The composition of claim 1, wherein the water swellable cationic polymer has a charge density of 4 to 5 meq/g.

7. The composition of claim 1, wherein the cationic linear copolymer (i) is derived from the polymerization of a salt of methacrylic acid and acrylamide.

8. The composition of claim 1, wherein in the polymerization of the cationic linear copolymer (i) the salt comprises a quaternary ammonium salt of an acrylate or methacrylate.

9. The composition of claim 1, wherein the cationic linear copolymer (i) has a molecular weight of from about 2 million to about 3 million.

10. The composition of claim 1, wherein the cationic cross-linked polymer (ii) is derived from the polymerization using 75 to 200 ppm of the cross-linking agent.

11. The composition of claim 1, wherein the cationic cross-linked polymer (ii) is derived from the polymerization of a salt of methacrylic acid and acrylamide.

12. The composition of claim 11, wherein in the polymerization of the cationic cross-linked polymer (ii) the salt comprises a quaternary ammonium salt of an acrylate or methacrylate.

13. The composition of claim 1, wherein in the polymerization of the cationic cross-linked polymer (ii), the polymer prior to cross-linking has a molecular weight of from about 2 million to about 3 million.

14. The composition of claim 1, wherein in the polymerization of the cationic cross-linked polymer (ii), the cross-linker comprises methylene bis acrylamide.

15. The composition of claim 1, wherein the composition comprises from 2.5 to 7.5 wt % fatty acid triglyceride, based on the weight of the composition.

16. The composition of claim 1, wherein the composition comprises from 0.05 to 0.5 wt % of the water swellable cationic polymer, based on the weight of the composition.

17. The composition of claim 1, wherein the weight ratio of fatty acid triglyceride to the water swellable cationic polymer is from 30:1 to 20:1.

18. The composition of claim 1, wherein the particles have an average particle size of from 3 to 10 microns.

19. The composition of claim 1, wherein the particles have an average particle size of from 0.1 to 2 microns.

20. The composition of claim 1, wherein the emulsion particles of the fatty acid triglyceride and the water swellable cationic polymer constitute the sole fabric conditioning component in the composition.

21. The composition of claim 1, wherein the composition comprises no chelating compound.

22. A method of producing a fabric conditioning composition according to claim 1, the method comprising the steps of:

a) providing water at a temperature of from 30 to 65° C.;

b) dispersing the fatty acid triglyceride and the water swellable cationic polymer, either together or independently in any order, into the water; and c) mixing the resultant dispersion to produce the composition in which the fatty acid triglyceride is dispersed as an aqueous emulsion, and the aqueous emulsion comprises particles including a mixture of the fatty acid triglyceride and the water swellable cationic polymer.

23. The method of claim 22, wherein in step a) the water is at a temperature of from 40 to 60° C.

24. The method of claim 22, wherein in step c) the mixing is carried out so that the particles have an average particle size of from 3 to 10 microns.

25. The method of claim 22, wherein in step c) the mixing is carried out for a period of from 1 to 4 minutes using a shearing mixer to form the emulsion.

26. The method of claim 22, wherein in step b) an oil phase comprising a mixture of the fatty acid triglyceride and the water swellable cationic polymer is dispersed into the water in the form of a molten liquid.

27. The method of claim 26, wherein the molten liquid includes fragrance.

28. The method of claim 22, the method further comprising the step of:

d) homogenizing the aqueous emulsion formed in step c) by passing the emulsion through a homogenizer at a pressure of from $2.1\times10^7$ to $1.03\times10^8$ Pa (3,000 to 15,000 psi) to form a homogenized emulsion.

29. The method of claim 28, wherein the homogenizing step d) is carried out at a pressure of from $3.4\times10^7$ to $8.9\times10^7$ Pa (5,000 to 13,000 psi).

30. The method of claim 28, wherein the homogenized emulsion comprises particles having an average particle size of from 0.1 to 2 microns.

31. The method of claim 28, wherein in the homogenizing step d) the emulsion is at a temperature of from 30 to 75° C.

32. The method of claim 28, wherein no chelating agent is mixed with the triglyceride prior to addition to water.

33. The method of claim 22 wherein the composition further comprises a fragrance and the method provides fragrance delivery onto the fabric.

* * * * *